US008480150B2

(12) United States Patent
Medwell et al.

(10) Patent No.: US 8,480,150 B2
(45) Date of Patent: Jul. 9, 2013

(54) ARMOR SYSTEM

(75) Inventors: Roger T. A. Medwell, Coventry (GB); David C. Batstone, Conventry (GB)

(73) Assignee: NP Aerospace Limited, Coventry (GB)

( * ) Notice: Subject to any disclaimer, the term of this patent is extended or adjusted under 35 U.S.C. 154(b) by 0 days.

(21) Appl. No.: 13/023,953

(22) Filed: Feb. 9, 2011

(65) Prior Publication Data

US 2011/0192275 A1 Aug. 11, 2011

(30) Foreign Application Priority Data

Feb. 10, 2010 (GB) ..... 1002246.5

(51) Int. Cl.
*B62D 33/06* (2006.01)
*F41H 7/02* (2006.01)

(52) U.S. Cl.
USPC ..... 296/29; 296/190.08; 89/36.08; 89/930; 89/937

(58) Field of Classification Search
USPC ..... 296/29, 202, 187.03, 148, 187.12, 296/187.07, 181.1, 193.06, 146.1, 191; 89/36.08, 930, 937, 36.07, 36.09; 411/338
See application file for complete search history.

(56) References Cited

U.S. PATENT DOCUMENTS

| | | | | |
|---|---|---|---|---|
| 1,273,515 | A * | 7/1918 | Makrenos | 109/81 |
| 1,501,790 | A * | 7/1924 | McClay et al. | 180/318 |
| 3,351,374 | A * | 11/1967 | Forsyth et al. | 89/36.02 |
| 4,150,422 | A * | 4/1979 | Peralta et al. | 362/218 |
| 4,965,138 | A * | 10/1990 | Gonzalez | 428/593 |
| 5,499,568 | A | 3/1996 | Turner | |
| 5,756,922 | A * | 5/1998 | Fuller | 89/36.02 |
| 6,082,240 | A * | 7/2000 | Middione et al. | 89/36.08 |
| 7,458,306 | B2 * | 12/2008 | Singh et al. | 89/36.02 |
| 7,600,808 | B2 * | 10/2009 | Hinze et al. | 296/190.08 |
| 2007/0234895 | A1 | 10/2007 | Singh et al. | |

FOREIGN PATENT DOCUMENTS

| | | |
|---|---|---|
| GB | 2479226 | 10/2011 |

OTHER PUBLICATIONS

UK Intellectual Property Office, "Search Report", in Application GB1102391.8, Jul. 28, 2011, 1 page.

* cited by examiner

*Primary Examiner* — Glenn Dayoan
*Assistant Examiner* — Sunsurraye Westbrook
(74) *Attorney, Agent, or Firm* — Dann, Dorfman, Herrell and Skillman; Clement A. Berard

(57) ABSTRACT

An armor panel assembly may comprise a set of bolts for attaching to a vehicle hull, an inner panel demountably attached to the bolts, and at least one outer panel demountably attached to the inner panel. The assembly may include a support panel for attaching the bolts to the hull and may further include brackets for mounting the support panel to the hull. Further, a kit of parts for forming a vehicle armor panel assembly may comprise a set of bolts for attaching to a vehicle hull, an inner panel demountably attachable to the bolts, and at least one outer panel demountably attachable to the inner panel.

20 Claims, 2 Drawing Sheets

ARMOR SYSTEM

This Application hereby claims the priority of United Kingdom Patent Application No. 1002246.5 filed Feb. 10, 2010 and entitled "ARMOR SYSTEM," filed by NP Aerospace Limited on behalf of Roger Arthur Terrence Medwell and David Charles Batstone, which UK Application is hereby incorporated herein by reference in its entirety.

This invention relates to a modular armor system.

BACKGROUND TO THE INVENTION

It is known to enhance the resistance to projectiles of a vehicle by fixing multilayered armor to the vehicle hull. In doing so it is important to balance the required threat-resistance with the increased weight and bulk. Generally the armor is permanently attached to the vehicle, which leads to a lack of versatility.

SUMMARY OF THE INVENTION

It is an aim of the invention to provide armor with a modular capability allowing easier armoring of vehicles of different dimensions as well as swift repairs and changes to the level of armor in the field.

The present invention provides an armor panel assembly comprising a set of bolts for attaching to a vehicle hull, an inner panel demountably attached to the bolts, and at least one outer panel demountably attached to the inner panel.

A support panel may be provided for attaching the bolts, which may be in the form of spacers, to the hull. Brackets may be provided for mounting the support panel to the hull.

Outer brackets may be provided for attaching the outer panel(s) to the inner panel. The outer panel may be formed with recesses accommodating the outer brackets.

Outriggers may be provided for supporting bar armor on an outer side of the armor panel.

The materials of the panels are selected from known by those skilled in the art as affording protection from blast waves, spall, bullets, fragments, etc. Thus they may include composites, polymers, ceramics (e.g. tiled ceramics) and metals.

The invention also provides a kit of parts for forming a vehicle armor panel, the kit comprising a set of bolts for attaching to a vehicle hull, an inner panel for demountable attachment to the bolts, at least one outer panel, and outer brackets for demountably attaching the outer panel to the inner panel.

BRIEF DESCRIPTION OF THE DRAWINGS

The invention will now be described in more detail, by way of example only, with reference to the accompanying drawings, in which.

DETAILED DESCRIPTION OF PARTICULAR EMBODIMENTS

Figure 1:
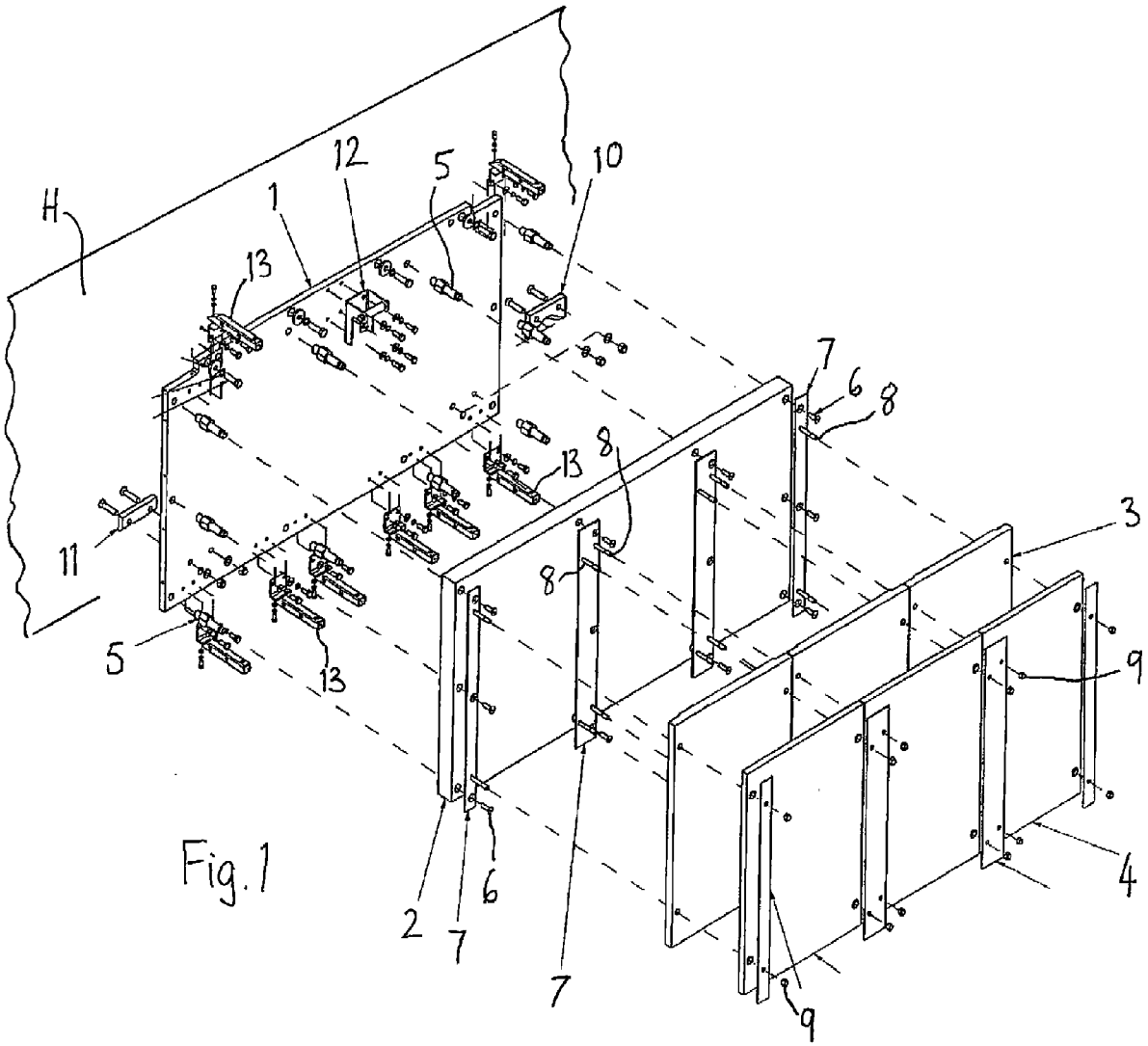
FIG. 1 is an exploded view of an armor panel according to the invention.

FIG. 1 shows an armor panel for attaching to a vehicle such as a personnel carrier. The armor panel comprises a rigid support panel 1, e.g. of aluminum, an inner panel 2, e.g. of a polymer or composite, a first outer panel 3 and a second outer panel 4. The outer panels 3, 4 may comprise ceramics, composites and/or other protective materials.

Spacers 5 attach the inner panel 2 to the support panel 1. The spacers 5 are in the form of integrally cast bolts having enlarged hexagonal sections **5*h* that maintain a space between the inner panel 2 and the support panel 1 as well as round sections 5*r* extending through suitable holes in these panels 1, 2. The inner panel 2 is screwed to the spacers or bolts 5 by means of screws 6**.

The screws 6 also retain outer brackets 7 in the form of elongate plates 7 on the inner panel 2. These brackets include bolts 8 extending through aligned holes in both outer panels 3, 4. The first inner panel 3 has recesses **3*r* accommodating the brackets 7. Nuts 9 secure the outer panels to the bolts 8**.

The support panel 1 is mounted to the vehicle hull H by means of first support brackets 10 and second support brackets 11, only one of each kind of bracket being depicted. First support brackets 10 have an inverted V-shaped recess whilst second support brackets 11 are bar-shaped.

The support panel 1 is provided with a lift handle 12. It is also fitted with a number of outriggers 13 for supporting external bar armor.

Figure 2:
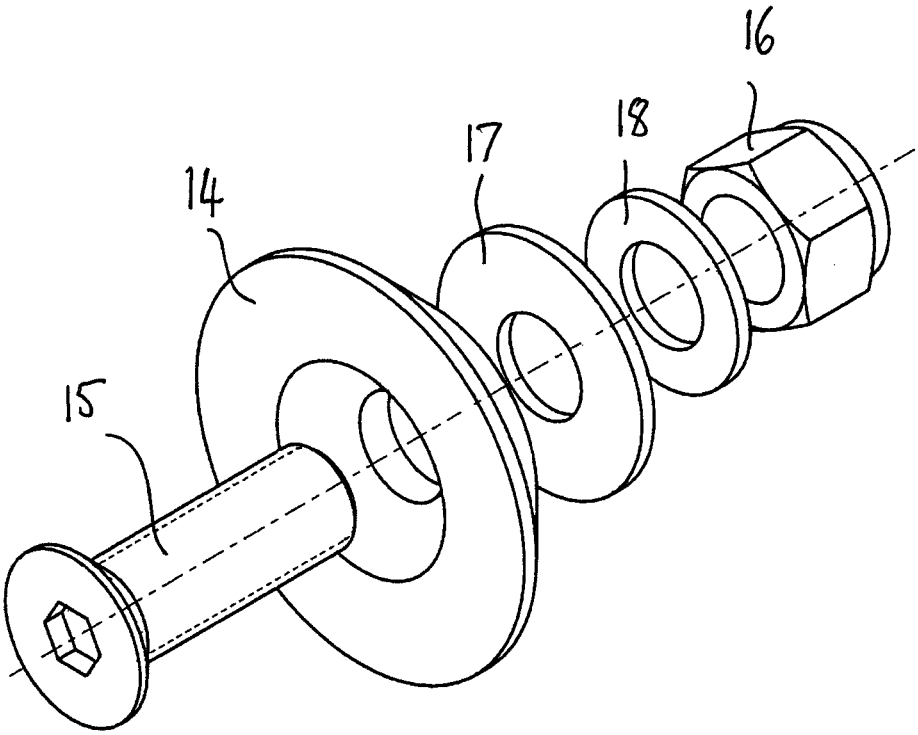
FIG. 2 shows a cone for attaching the armor panel to a support bracket shown in FIG. 1.

In order to armor a vehicle, the armor plate is assembled as shown in FIG. 1 before attaching it to a vehicle. Then the first support brackets 10 are lowered into place over cones 14 such as that shown in FIG. 2 and the second support brackets 11 are attached to the vehicle hull H or to a bar thereon. Each truncated cone 14 is attached to the vehicle hull by means of a threaded bolt 15 passing through the cone 14 and a nut 16 located inside the vehicle hull H. A spacer disc 17 is located outside the vehicle hull H and a washer 18 is located inside. Bolt 15 has hexagonal recess in a conical shaped head that fits into a recess in cone 14.

The second support brackets 11 are attached to the vehicle hull H or to a bar thereon.

The armor of the invention provides protection against explosively formed projectiles. When there is a low likelihood of these, the outer e.g. ceramic layers 3, 4 can still provide protection against small arms fire. It is possible to remove the inner and outer panels and then remount the outer panels 3, 4 on the spacers 5 without the inner panels 2 to save weight. A further advantage of the invention is that repairs can be carried out rapidly in the field, with damaged panels being exchanged and intact panels retained.

An armor panel assembly may comprise a set of bolts or spacers 5 for attaching to a vehicle hull H, an inner panel 2 demountably attached to the bolts or spacers 5, and at least one outer panel 3, 4 demountably attached to the inner panel 2. The assembly may also include a support panel 1 for attaching the bolts or spacers 5 to the hull H, and may further include brackets 10, 11 for mounting the support panel 1 to the hull H. The assembly may include outer brackets 7 for attaching the outer panel(s) 3, 4 to the inner panel 2, and the outer panel 3, 4 may be formed with recesses accommodating the outer brackets 7. The assembly may include outriggers 13 for supporting bar armor on an outer side of the armor panel. The bolts or spacers 5 may comprise spacers 5 having enlarged portions for spacing the inner panel 2 from the hull H, and the enlarged portions may be of non-circular cross section.

A kit of parts for forming a vehicle armor panel assembly may comprise a set of bolts or spacers 5 for attaching to a vehicle hull H , an inner panel 2 demountably attachable to the bolts or spacers 5, and at least one outer panel 3, 4 demountably attachable to the inner panel 2. The kit of parts may include outer brackets 7 for attaching the outer panel(s) 3, 4 to the inner panel 2, and the outer panel 3, 4 may be formed with recesses for accommodating the outer brackets 7. The kit of parts may include outriggers 13 for supporting bar armor on an outer side of the armor panel. The bolts or spacers 5 may comprise spacers 5 having enlarged portions for spacing the inner panel 2 from the hull H, and the enlarged portions may be of non-circular cross section.

An armor panel assembly may comprise: a support panel 1 for attaching to a vehicle hull H; brackets 10, 11 for mounting the support panel 1 to the vehicle hull H; a set of bolts or spacers 5 for attaching to the support panel 1, the bolts or spacers 5 having an enlarged section one end of which is at the support panel 1; an inner panel 2 demountably attached to the bolts or spacers 5 at the other end of the enlarged section thereof, and at least one outer panel 3, 4 demountably attached to the inner panel 2. The support panel 1 may be aluminum, the inner panel 2 may be polymer or composite, and the at least one outer panel 3, 4 may be ceramic or composite. The enlarged section of the bolts or spacers 5 may be a hexagonal section 5*h*, the bolts or spacers 5 may further have a round section 5*r* adjacent the enlarged hexagonal section 5*h* , wherein the round section 5*r* receives screws 6 attaching the inner panel 2 thereto. The assembly may include outer brackets 7 for attaching the outer panel(s) 3, 4 to the inner panel 2. The outer panel 3, 4 may be formed with recesses 3*r* accommodating the outer brackets 7. The assembly may further include outriggers 13 for supporting bar armor on an outer side of the armor panel assembly.

Modifications which do not depart for the claims will readily occur to the skilled reader. For example, there could be two inner panels with or without spacing therebetween. The ceramic layer(s) could be replaced by various other layers known in the art, and one or more additional layers—either demountable or fixed to another layer—of polymer, ceramic, glass or metallic materials could be added.

What is claimed is:

1. An armor panel assembly comprising a set of bolts for attaching to a vehicle hull, a support panel for attaching the bolts to the hull, an inner panel demountably attached to the bolts, and at least one outer panel demountably attached to the inner panel.

2. An assembly according to claim 1, including brackets for mounting the support panel to the hull.

3. An assembly according to claim 1, including outer brackets for attaching the outer panel(s) to the inner panel.

4. An assembly according to claim 3, wherein the outer panel is formed with recesses accommodating the outer brackets.

5. An assembly according to claim 1, including outriggers for supporting bar armor on an outer side of the armor panel assembly.

6. An assembly according to claim 1, wherein the bolts comprise spacers having enlarged portions for spacing the inner panel from the hull.

7. An assembly according to claim 6, wherein the enlarged portions are of non-circular cross section.

8. A kit of parts for forming a vehicle armor panel assembly, the kit comprising a support panel for attaching to a vehicle hull, a set of bolts for attaching to the support panel., an inner panel demountably attachable to the bolts, and at least one outer panel demountably attachable to the inner panel.

9. A kit of parts according to claim 8, including outer brackets for attaching the outer panel(s) to the inner panel.

10. A kit of parts according to claim 9, wherein the outer panel is formed with recesses for accommodating the outer brackets.

11. A kit of parts according to claim 8, including outriggers for supporting bar armor on an outer side of the armor panel assembly.

12. A kit of parts according to claim 8, wherein the bolts comprise spacers having enlarged portions for spacing the inner panel from the hull.

13. A kit of parts according to claim 12, wherein the enlarged portions are of non-circular cross section.

14. An armor panel assembly comprising:

a support panel for attaching to a vehicle hull;

brackets for mounting the support panel to the vehicle hull;

a set of bolts for attaching to the support panel, the bolts having an enlarged section one end of which is at the support panel;

an inner panel demountably attached to the bolts at the other end of the enlarged section thereof, and at least one outer panel demountably attached to the inner panel.

15. An assembly according to claim 14, wherein the support panel is aluminum, the inner panel is polymer or composite, and the at least one outer panel is ceramic or composite.

16. An assembly according to claim 14, wherein the enlarged section of the bolts is a hexagonal section, the bolts further having a round section adjacent the enlarged hexagonal section, wherein the round section receives screws attaching the inner panel thereto.

17. An assembly according to claim 14, including outer brackets for attaching the outer panel(s) to the inner panel.

18. An assembly according to claim 17, wherein the outer panel is formed with recesses accommodating the outer brackets.

19. An assembly according to claim 14, further including outriggers for supporting bar armor on an outer side of the armor panel assembly.

20. An assembly according to claim 14, wherein the bolts comprise spacers having enlarged portions for spacing the inner panel from the hull.

* * * * *